US010068547B2

(12) United States Patent
Sobeski et al.

(10) Patent No.: US 10,068,547 B2
(45) Date of Patent: Sep. 4, 2018

(54) AUGMENTED REALITY SURFACE PAINTING

(75) Inventors: David Sobeski, Seattle, WA (US); Brian Leake, Los Angeles, CA (US); Kenny Mitchell, Addlestone (GB)

(73) Assignee: Disney Enterprises, Inc., Burbank, CA (US)

( * ) Notice: Subject to any disclaimer, the term of this patent is extended or adjusted under 35 U.S.C. 154(b) by 326 days.

(21) Appl. No.: 13/538,644

(22) Filed: Jun. 29, 2012

(65) Prior Publication Data

US 2014/0002472 A1 Jan. 2, 2014

(51) Int. Cl.
*G09G 5/00* (2006.01)
*G09G 5/02* (2006.01)

(52) U.S. Cl.
CPC ..... *G09G 5/026* (2013.01)

(58) Field of Classification Search
CPC .. G09G 5/00; G09G 2300/026; G06T 19/006; G06T 11/60; G06T 15/00; G06T 17/00; G06T 19/20; G06T 2207/30244; G06T 2219/2016; G06T 17/05; G06T 2215/16; G06T 19/00; G06F 3/013
USPC ..... 345/589, 633, 582
See application file for complete search history.

(56) References Cited

U.S. PATENT DOCUMENTS

2007/0205963 A1* 9/2007 Piccionelli ..... G09F 19/00 345/7
2009/0079743 A1* 3/2009 Pearson et al. ..... 345/473
2009/0111434 A1* 4/2009 Yu ..... H04L 51/14 455/414.1
2010/0030578 A1* 2/2010 Siddique et al. ..... 705/3
2010/0238161 A1* 9/2010 Varga ..... G06T 17/05 345/419
2011/0098056 A1* 4/2011 Rhoads et al. ..... 455/456.1
2012/0013613 A1* 1/2012 Vesely ..... 345/419
2012/0190455 A1* 7/2012 Briggs ..... 463/42
2013/0002698 A1* 1/2013 Geiger et al. ..... 345/589

OTHER PUBLICATIONS

Lincoln, Peter et al., Animatronic shader lamps avatars, Proceedings of the 2009 8th IEEE International Symposium on Mixed and Augmented Reality, 2009, IEEE Computer Society, Washington, D.C., United States.

String, Scrawl: Features Demo, Vimeo, LLC, uploaded Jul. 9, 2011, <http://vimeo.com/16430181>.

* cited by examiner

*Primary Examiner* — Samantha (Yuehan) Wang
(74) *Attorney, Agent, or Firm* — Patterson + Sheridan, LLP

(57) ABSTRACT

Techniques for simulating interactions using an augmented reality device are described. Embodiments receive a request to paint over portions of a visual scene. Here, the visual scene is captured using one or more camera devices of the augmented reality device and is presented on a display of the augmented reality device. A first object in the visual scene corresponding to the first location is identified. Additionally, embodiments paint at least a portion of the first object as specified by the received request, and render a series of frames depicting the first object, such that the painted at least a portion of the first object is shown as painted when viewed from different perspectives using the augmented reality device.

27 Claims, 8 Drawing Sheets

AUGMENTED REALITY SURFACE PAINTING

BACKGROUND

Field of the Invention

The present invention generally relates to a human-computer interface and more specifically to techniques for painting surfaces on an augmented reality device.

Description of the Related Art

Computer graphics technology has come a long way since video games were first developed. Relatively inexpensive 3D graphics engines now provide nearly photo-realistic interactive game play on hand-held video game, home video game and personal computer hardware platforms costing only a few hundred dollars. These video game systems typically include a hand-held controller, game controller, or, in the case of a hand-held video game platform, an integrated controller. A user or player uses the controller to send commands or other instructions to the video game system to control a video game or other simulation being played. For example, the controller may be provided with a manipulator (e.g., a joystick) and buttons operated by the user.

Many hand-held gaming devices include some form of camera device which may be used to capture an image or a series of images of a physical, real-world scene. The captured images can then be displayed, for instance, on a display of the hand-held gaming device. Certain devices may be configured to insert virtual objects into the captured images before the images are displayed. Additionally, other devices or applications may enable users to draw or paint particular within a captured image of a physical scene. However, as such alterations apply only to a single image of the physical scene, subsequent captured images of the physical scene from different perspectives may not incorporate the user's alterations.

SUMMARY

Embodiments provide a method, augmented reality device and computer-readable storage medium for displaying content using an augmented reality device. The method, augmented reality device and computer-readable storage medium include receiving a request to paint over portions of a visual scene, where the visual scene is captured using one or more camera devices of the augmented reality device and is presented on a display of the augmented reality device. Additionally, the method, augmented reality device and computer-readable storage medium include identifying a first object depicted by the visual scene corresponding to the first location. The method, augmented reality device and computer-readable storage medium further include painting at least a portion of the first object as specified by the received request. The method, augmented reality device and computer-readable storage medium also include rendering a series of frames depicting the first object, such that the painted at least a portion of the first object is shown as painted when viewed from different perspectives using the augmented reality device.

BRIEF DESCRIPTION OF THE DRAWINGS

So that the manner in which the above recited aspects are attained and can be understood in detail, a more particular description of embodiments of the invention, briefly summarized above, may be had by reference to the appended drawings.

It is to be noted, however, that the appended drawings illustrate only typical embodiments of this invention and are therefore not to be considered limiting of its scope, for the invention may admit to other equally effective embodiments.

DETAILED DESCRIPTION

Figure 1:
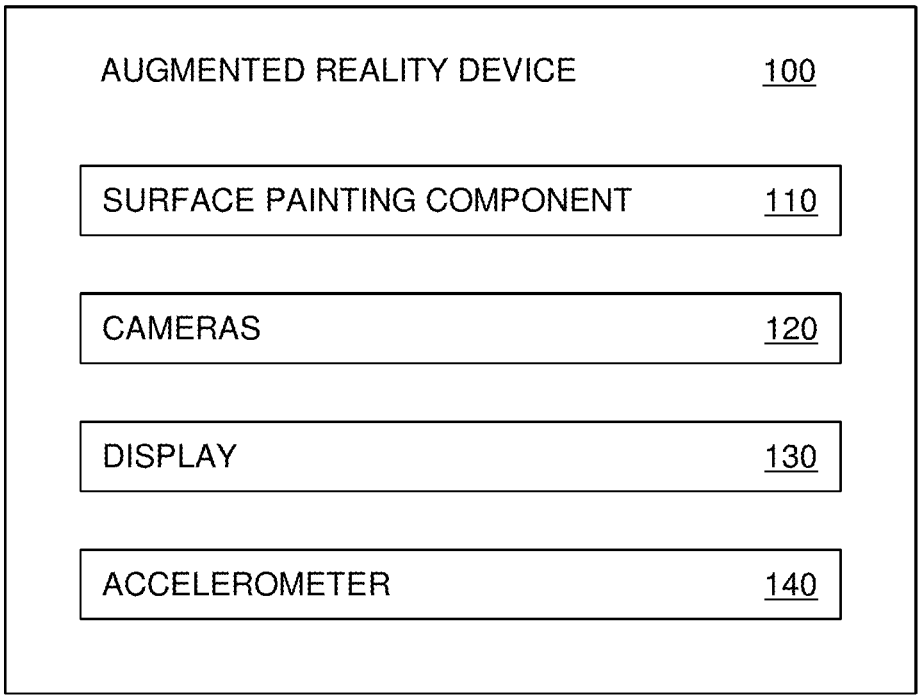
FIG. 1 is a block diagram illustrating an augmented reality device configured with a surface painting component, according to one embodiment described herein.

Embodiments of the invention provide techniques for displaying content on an augmented reality device. As used herein, an augmented reality device refers to any device capable of displaying a real-time view of a physical, real-world environment while altering elements within the displayed view of the environment. As such, unlike a virtual reality device which displays a view of virtual world, an augmented reality device displays a view of the real world but augments elements using computer graphics technology. Such an augmented reality device may include a camera device (or multiple camera devices) used to capture a view of the real-world environment and may further include computer software and/or hardware configured to augment elements of the captured scene. For example, an augmented reality device could capture a series of images of a coffee cup sitting on top of a table, modify the series of images so that the coffee cup appears as an animated cartoon character and display the modified series of images in real-time to a user. As such, when the user looks at the augmented reality device, the user sees an augmented view of the physical real-world environment in which the user is located.

Additionally, some augmented reality devices may allow users to alter captured images by drawing or painting within a captured image. For example, a user could color in an image of the coffee cup sitting on a table to paint the coffee cup yellow. However, one challenge for such augmented reality devices is that, if the user then views the coffee cup from a different angle, the user's drawing may be incorrectly sized and/or shaped relative to the physical environment viewed from the new perspective, and thus the drawing may not appear to be a part of the physical environment. For example, if the user alters the perspective at which the coffee cup is viewed, the coffee cup could appear larger (or smaller) on the display of the augmented reality device (i.e., based on the distance between the coffee cup and the camera of the augmented reality device). In such a situation, the user's drawing may remain a fixed size, thus appearing as too small (or too large) to properly color the coffee cup.

As another example, the user could alter the perspective at which the coffee cup is viewed, such that the shape of the coffee cup appears different when viewed on the augmented reality device (e.g., a side perspective versus a top-down perspective). In such an example, the fixed shape of the user's drawing may be inconsistent with the shape of the coffee cup. As yet another example, the user could alter the focal point of the augmented reality device, so that the coffee cup appears in a different position on the screen of the augmented reality device. In such an example, the user's drawing may remain in a fixed location on the screen, and thus may no longer appear over the coffee cup in its new position on the screen. In all three examples, the result is a less realistic display for the augmented reality device, which may negatively affect the user's experience in using the augmented reality device.

As such, embodiments described herein provide techniques for simulating interactions using an augmented reality device. For instance, software on a handheld device could receive a request to paint over elements of a visual captured using one or more camera devices of the device. The request could specify, for instance, a free-form shape created by the user (e.g., using a virtual paint brush) and a color (or multiple colors) for the free-form shape. In one embodiment, the request may specify a predefined graphic selected by the user. For instance, the user could select a particular logo to paint onto a surface within the augmented reality world (i.e., the augmented reality space depicted on the display of the augmented reality device). In a particular embodiment, the request could further specify a texture for the free-form shape or predefined graphic. As an example, the user could paint a free-form graphic using a virtual paint brush and could select one of a plurality of predefined textures (e.g., leather, denim, scales, paper, etc.) to apply to the free-form graphic.

Additionally, the software could identify a first physical object within the visual scene corresponding to the first location specified by the request. For instance, embodiments could analyze the visual scene to determine the border edges of objects within the visual scene, and could use these border edges in order to identify one or more physical objects existing within the visual scene. Of note, as the captured visual scene represents a three-dimensional space (e.g., a physical environment captured using a camera of the augmented reality device), embodiments may be configured to estimate a three-dimensional space occupied by each of the physical objects within the captured scene. That is, the software could be configured to estimate the three-dimensional surfaces of physical objects within the captured scene.

In response to receiving the request to paint over elements of the visual scene, the software could determine which identified object(s) occupy that location of the visual scene. Continuing the above example, a user wishing to paint a coffee cup within the visual scene yellow could submit a request with a free-form drawing, coloring in the area of the visual scene occupied by the coffee cup yellow. In response to such a request, the software could identify the coffee cup within the visual scene as a physical object present within the visual scene, and could further determine that the user's free-form drawing is directed at the space occupied by the coffee cup.

The software could adjust the visual scene by painting at least a portion of the identified first physical object as specified by the received request. For instance, the software could color the three-dimensional surfaces of coffee cup within the visual scene with the shade of yellow specified by the user. The software may then render a series of frames depicting the painted object and output the frames for display on the augmented reality device. Additionally, because embodiments identify the three-dimensional space a painted object occupies within the three-dimensional augmented reality space depicted on the display of the augmented reality device, the software could persist the alteration of the physical object over multiple frames showing different perspectives of the physical environment, such that the portion of the physical object remains painted when viewed from different perspectives using the augmented reality device. In other words, the software could render the painted object in such a way that the painted object (or portion of an object) appears to remain fixed in its original position within the physical environment shown on the augmented reality device.

Thus, for example, if the user moves the augmented reality device such that the camera views the physical object from a different perspective, the software could render the painted object to match the new perspective. For instance, if the user adjusts the device from viewing the coffee cup from a side perspective to viewing the coffee cup from a top-down perspective, the software could render the top-down view of the coffee cup to reflect the paint request. Thus, for example, the software could render the coffee cup as yellow in accordance with the received request when the cup is viewed from different perspectives (e.g., the top-down perspective). Advantageously, doing so provides a more immersive augmented reality experience for the user, as the user can paint the surfaces of objects within the augmented reality world and the user's painting will persist and remain accurate to the depicted physical environment, even when the environment is viewed from different perspectives using the augmented reality device.

In one embodiment, the software uses predefined geometric data to recognize objects within the visual scene and to apply painting effects to the surfaces of these objects. For instance, the software could be configured with predefined geometric data indicating the size, shape and color of a particular coffee cup. The software could then determine whether any portion(s) of a captured scene match these specifications, and, if so, could determine that the matching portion of the visual scene corresponds to a physical coffee cup object. As another example, embodiments could use predefined geometric data characterizing the size and shape of various physical objects in order to estimate a depth of a physical object (i.e., a three-dimensional position) within the captured scene.

As an example, assume that the geometry information indicates that a particular ball is 3 inches in diameter and that the visual scene includes two instances of that type of ball, where the first instance is shown using 10 pixels of the visual scene and the second instance is shown using 50 pixels of the visual scene. In such an example, the software could determine that the first instance of the ball is further away from the camera than the second instance of the ball, as the geometry information indicates that the two physical balls are the same size but the first instance is represented using fewer pixels than the second instance. Advantageously, by preconfiguring the augmented reality device with geometric data for certain physical objects, embodiments may more accurately identify those physical objects within a visual scene. Additionally, software on the augmented reality device may use the predefined geometric data to more accurately apply the user's painting to the surface of the physical object. For instance, embodiments could use geometric data characterizing the physical object's size, shape and texture to more accurately render the user's painting on the surface of the physical object.

FIG. 1 is a block diagram illustrating an augmented reality device configured with a display correction component, according to one embodiment of the present invention. As shown, the augmented reality device 100 includes a surface painting component 110, camera devices 120, a display device 130 and an accelerometer 140. The camera devices 120 may include cameras for capturing a visual scene. As used herein, a visual scene refers to a view(s) of the real-world environment in which the device 100 is being used. For instance, a visual scene may be a series of images of a real-world environment. The camera devices 120 may also include one or more user-facing cameras. The display correction component 110 could use such a user-facing camera device 120 to, e.g., determine an angle at which the user is viewing the display device 130. Generally, the accelerometer 140 is a device capable of measuring the physical (or proper) acceleration of the augmented reality device 100. The display correction component 110 may use the accelerometer 140 to, e.g., determine when the position of the augmented reality device 100 is changing, which could indicate the user's viewing angle of the display device 130 is also changing.

Generally, the surface painting component 110 is configured to receive a request to paint a specified location within a visual scene (e.g., a series of frames captured using the camera devices 120) and to adjust the visual scene such that objects at the specified location are painted in the requested fashion and remain painted even when viewed from different perspectives through the display device 130. For instance, the surface painting component 110 could analyze a visual scene captured using the cameras 120 and identify physical objects within the visual scene. More specifically, as the visual scene represents a three-dimensional space (i.e., the physical environment captured using the cameras 120), the surface painting component 110 could determine an area of three-dimensional space occupied by each identified physical object. For example, the surface painting component 110 could be preconfigured with geometric data that defines geometric properties (e.g., size, shape, color, etc.) for particular predefined objects, and could use the geometric data to identify instances of the predefined objects within the visual scene and the three-dimensional space each object occupies. Once the objects are identified, the surface painting component 110 could determine which object(s) occupy the location specified by the request.

The surface painting component 110 could then apply the requested painting to the surface(s) of the determined object(s) and could render frames depicting the painted surfaces, such that the surfaces are depicted as painted even when the physical scene is viewed from different perspectives. For instance, the surface painting component 110 could estimate the three-dimensional surfaces of the object within the captured two-dimensional scene and could render the surfaces of the object as painted in the requested fashion. Advantageously, by coloring a three-dimensional representation of the physical object within the visual scene, the surface painting component 110 can depict the painted object from perspectives other than the original perspective from which the user originally painted the object.

Figure 2A:
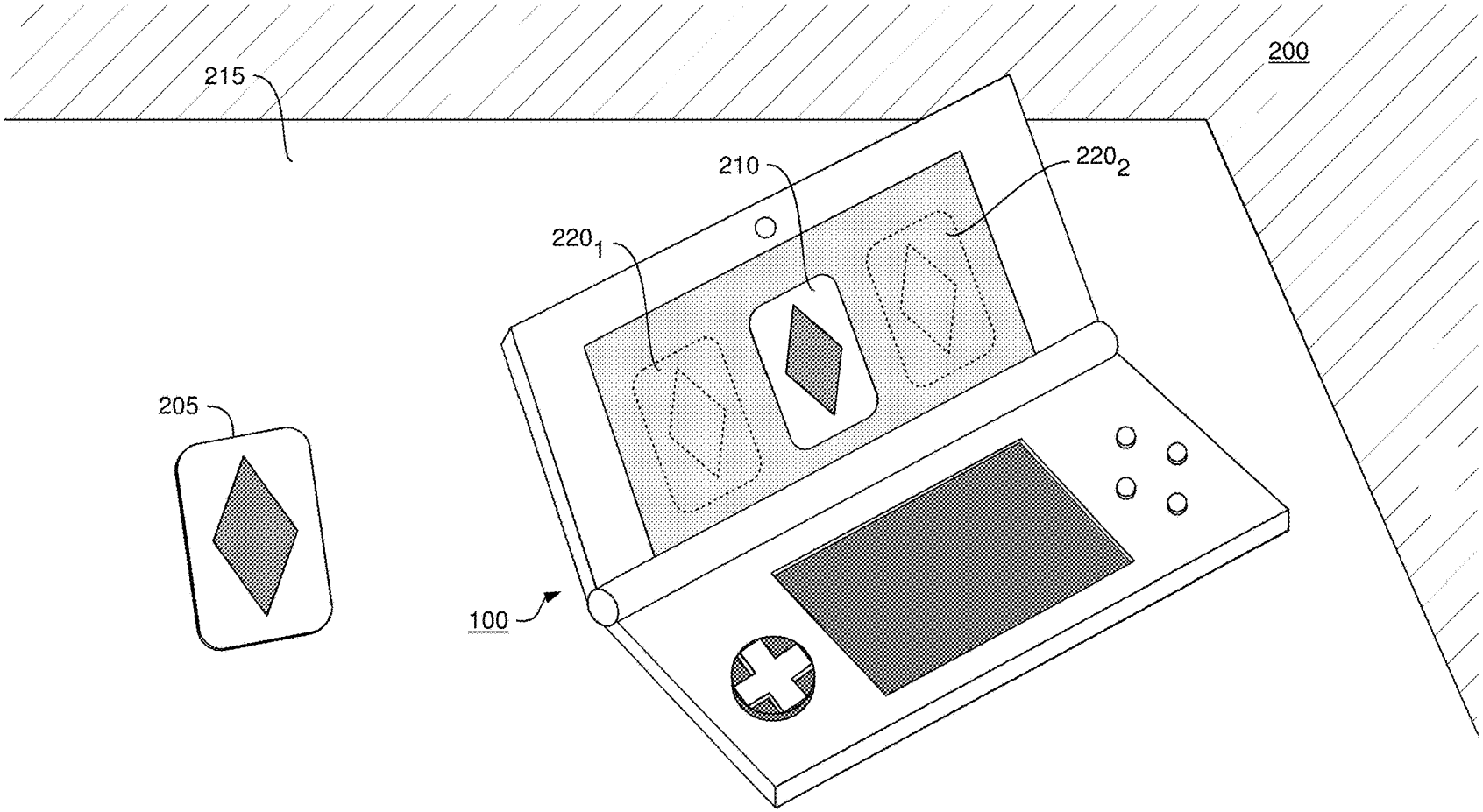
FIG. 2A-D are diagrams illustrating augmented reality devices, according embodiments described herein.

In one embodiment, the surface painting component 110 is configured to paint predefined virtual objects selected by the user into the augmented reality world. In a particular embodiment, the surface painting component 110 is configured to paint particular physical objects selected by the user out of the augmented reality world. Examples of this will now be discussed with regard to FIG. 2A-D, which are diagrams illustrating augmented reality devices according to embodiments. FIG. 2A shows a scene 200 containing a table 215 with a playing card 205 resting atop it, and the augmented reality device 100. A virtual representation 210 of the card 205 is shown on the display of the augmented reality device 100.

Here, the user could submit a request to paint the virtual representation 210. For instance, the user could select a paintbrush tool on an interface of the augmented reality device 100 and could select a color to paint the virtual representation 210. For example, assume that the diamond on the physical card 205 is colored red, and thus the diamond on the virtual representation 210 originally appears as red as well. In such an example, the user could use the paintbrush tool to paint the diamond of the virtual representation 210 as blue. The surface painting component 110 could then render the virtual representation 210 with a blue diamond, regardless of the perspective from which the user views the physical card 205 using the augmented reality device 100.

Additionally, the display includes two predefined virtual playing card objects $220_{1-2}$. Generally, the predefined virtual objects $220_{1-2}$ represent objects having predefined geometric characteristics (e.g., shape, size, color, etc.) that can be painted into the displayed augmented reality scene by the user. Such predefined virtual objects $220_{1-2}$ could be automatically inserted into the augmented reality scene displayed on the device 100. In one embodiment, the user can select the predefined virtual objects $220_{1-2}$ from a list of predefined objects and could specify how the selected objects should be inserted into the displayed scene. For example, the user could select the predefined playing card virtual objects $220_{1-2}$ and could specify that the first predefined object $220_1$ should be inserted to the left of the virtual representation 210 in the displayed scene, and the second predefined object $220_2$ should be inserted to the right of the virtual representation 210 in the displayed scene.

Figure 2B:
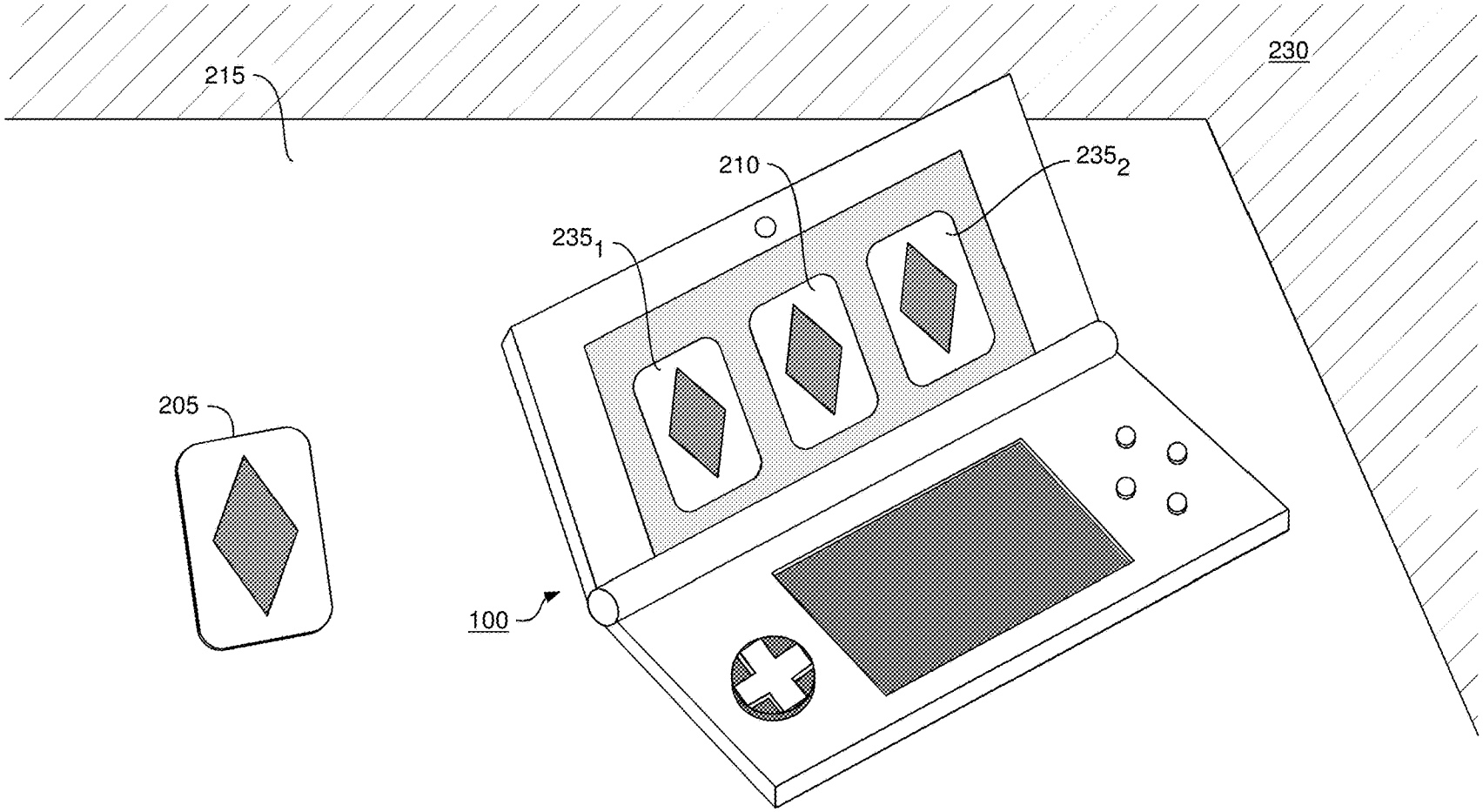

The user could then choose to paint the predefined virtual objects $220_{1-2}$ into the scene. For instance, the user could select a paintbrush tool and a color of paint to use, and could then apply the paintbrush to the predefined virtual objects $220_{1-2}$ to transform them into painted virtual objects. An example of this is shown in FIG. 2B, which depicts a scene 230 in which the playing card 205 rests upon the table 215, and where a virtual representation 210 of the card 205 is displayed on the augmented reality device 100. Additionally, the depicted scene 230 illustrates that the predefined virtual objects $220_{1-2}$ have been painted into the scene by the user as painted virtual objects $235_{1-2}$. Here, the color of the painted virtual objects $235_{1-2}$ may be based on the color of paint the user applied to the predefined virtual objects $220_{1-2}$. For instance, while the diamond in the physical playing card 205 and its virtual representation 210 could be colored red, the user could choose to paint in the virtual objects $235_{1-2}$ with green and blue diamonds, respectively.

Moreover, the surface painting component 110 could insert the painted virtual objects $235_{1-2}$ as three-dimensional objects within the augmented reality scene, such that these objects will remain in fixed positions on the table top relative to the virtual representation 210 of the physical card 205, when the painted virtual objects $235_{1-2}$ are viewed from different perspectives using the augmented reality device 100. That is, once the virtual objects $235_{1-2}$ are painted into the augmented reality scene, the user could walk around the room viewing the physical card 205 from different perspectives on the augmented reality device 100, while the painted cards $235_{1-2}$ remain in a fixed position relative to the virtual representation 210 regardless of the user's perspective. Additionally, the surface painting component 110 may render the size and shape of the painted virtual objects $235_{1-2}$ based on the user's viewing perspective, such that the objects $235_{1-2}$ realistically appear to exist within the depicted scene. As an example, if the user views the virtual representation 210 of the physical card 205 from a perspective in which the card appears on its side, the painted virtual objects $235_{1-2}$ would be shown as on their side as well. Advantageously, doing so provides a more immersive augmented reality experience for users of the augmented reality device 100, as the painted objects $235_{1-2}$ are displayed as if they were physical cards resting on the table 215, rather than merely fixed drawings (e.g., sprites) inserted into an image.

In one embodiment, the surface painting component 110 could detect when a user has painted in a predefined percentage of one of the predefined virtual objects and could automatically fill in the rest of the predefined virtual object. For instance, the surface painting component 110 could be configured to detect when a user has painted in 70% of the predefined virtual object $220_1$, and to automatically paint in the remaining 30% of the object $220_1$. Advantageously, doing so enables users to more quickly paint predefined virtual objects into the scene and may alleviate user frustration caused by a virtual object not appearing because the user has failed to paint in a small portion of the predefined virtual object.

In particular embodiments, the virtual objects may be animated objects once painted into the visual scene. For example, once the user paints in the predefined virtual object $220_1$ to create the virtual object $235_1$, the virtual object $235_1$ could appear as an animated playing card capable of moving around the displayed table top and interacting with other virtual objects within the scene. Such an embodiment is well suited, for instance, for use in an augmented reality computer game, as the user can paint virtual characters into (or out of) the augmented reality game world, thereby providing a more interactive gaming experience for the user.

Additionally, the surface painting component 110 could be configured to allow a user to paint particular portions of virtual objects within the visual scene. For instance, a particular augmented reality game could include a virtual character who is well known as wearing a red hat. As such, the surface painting component 110 could be configured to detect when the user has painted a predefined virtual object corresponding to the character's hat red, and if so, could create an animated virtual object of the character within the augmented reality scene. Additionally, such an embodiment could be extended to require other portions of the predefined virtual object to be painted the same or a different color before the virtual object will fully appear within the augmented reality scene. Advantageously, doing so provides an interactive experience which challenges users to paint predefined virtual objects in particular ways in order to introduce virtual objects (e.g., an animated character) into the augmented reality world.

As another example, the surface painting component 110 could be configured to allow the user to paint onto the surfaces of virtual objects within the augmented reality space. For example, an animated virtual character and a virtual house could be incorporated into the augmented reality scene displayed on the augmented reality device. The user could then request (e.g., using an input device of the augmented reality device) to paint onto the surface of one of the virtual objects (i.e., the animated virtual character or the virtual house) within the augmented reality scene. For instance, the user could interact with a touch screen of the augmented reality device using a stylus and could draw a shape on a first location of the screen to be painted onto a virtual object within the scene (e.g., a selected virtual object, a virtual object corresponding to the first location, etc.). The surface painting component 110 could then paint the virtual object in accordance with the user's request, and in such a way that the virtual object will appear as painted in the requested fashion when viewed from multiple perspectives using the augmented reality device. Advantageously, doing so provides an interactive and immersive augmented reality experience for the user of the augmented reality device, in which the user can realistically paint both physical and virtual objects within the augmented reality scene.

Figure 2C:
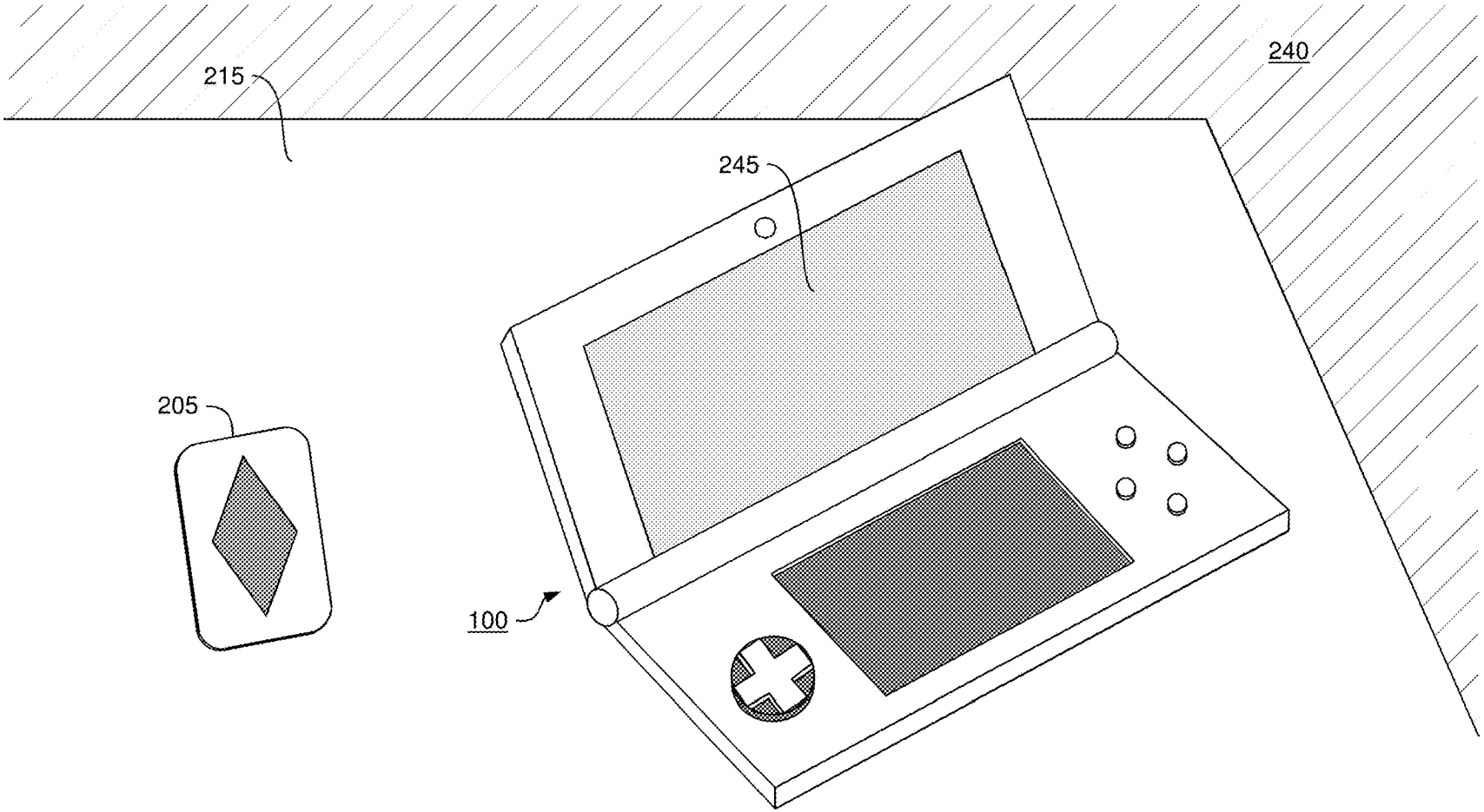

As discussed above, in a particular embodiment, the surface painting component 110 could also be configured to paint physical objects out of the augmented reality scene. For instance, the user could select the virtual representation 210 of the physical card 205 to paint out of the augmented reality scene. For example, the user could select a paint thinner option within an interface of the augmented reality device 100 and could then select the virtual representation 210 for removal by selecting the area of the augmented reality scene where the virtual representation 210 is located. An example of this is shown in FIG. 2C, which illustrates a scene 240 including the table 215, the physical card 205 and the augmented reality device 100. In response to the user's selection, the surface painting component 110 could determine that the virtual representation 210 is associated with the location of the augmented reality scene selected by the user. The surface painting component 110 could then paint the virtual representation 210 out of the augmented reality scene. For example, the surface painting component 110 could analyze the area surrounding the virtual representation 210 (i.e., the virtual representation of the surface of the table 215) and could generate replacement content for the removed object having the same visual characteristics as the surrounding area. For instance, the surface painting component 110 could generate replacement content having the color, texture and reflectivity of the surrounding area of the table 215.

As a note, the shape and size of a physical object may vary when the object is viewed on the augmented reality device 100, based on the perspective in which the device 100 is viewing the object. That is, a coffee cup may appear to have a first shape when viewed from a side-on perspective, but may appear to have a different shape when viewed from a top-down perspective. As another example, the coffee cup may be displayed using the entire screen of the augmented reality device 100 when the device 100 (or more specifically, one of the cameras 120 of the device 100) is held close to the physical coffee cup, while the same physical coffee cup may be displayed using only a small portion of the screen when the device 100 is positioned far away from the physical cup. As such, when painting a particular object out of an augmented reality scene, the surface painting component 110 may determine the three-dimensional area within the augmented reality space occupied by the object (e.g., the virtual representation 210) within a captured visual scene.

The surface painting component 110 may then paint virtual representations of objects out of an augmented reality scene 245, such that when the objects are still removed from the augmented reality scene 245 when the objects are viewed from different perspectives using the augmented reality device 100. That is, by determining a three-dimensional representation of an object in a captured visual scene, embodiments may then determine which portion of corresponding frames of the visual scene represent different views of the same object. Advantageously, doing so provides a more realistic and immersive augmented reality experience for users of the device 100, as objects the users have painted out of the augmented reality scene 245 remain removed from the scene, regardless of the perspective the user views the corresponding physical object from.

Additionally, the surface painting component 110 could be configured to paint free-form drawings onto surfaces within an augmented reality space. For instance, a user could create a free-form drawing using an interface of the augmented reality device and could select a location within the augmented reality scene to insert the free-form drawing. The surface painting component 110 could then determine an object within the scene that corresponds to the selected location and could determine a three-dimensional area occupied by the object within the augmented reality world. The surface painting component 110 could then apply the user's free-form drawing to the surface of the three-dimensional area. Advantageously, by doing so, embodiments can render the user's drawing as if the drawing is part of the object, such that the size and shape of the drawing may change depending on the perspective from which the object is viewed, or all or part of the drawing could be occluded by other objects within the augmented reality space, when the object is viewed from other perspectives.

Figure 2D:
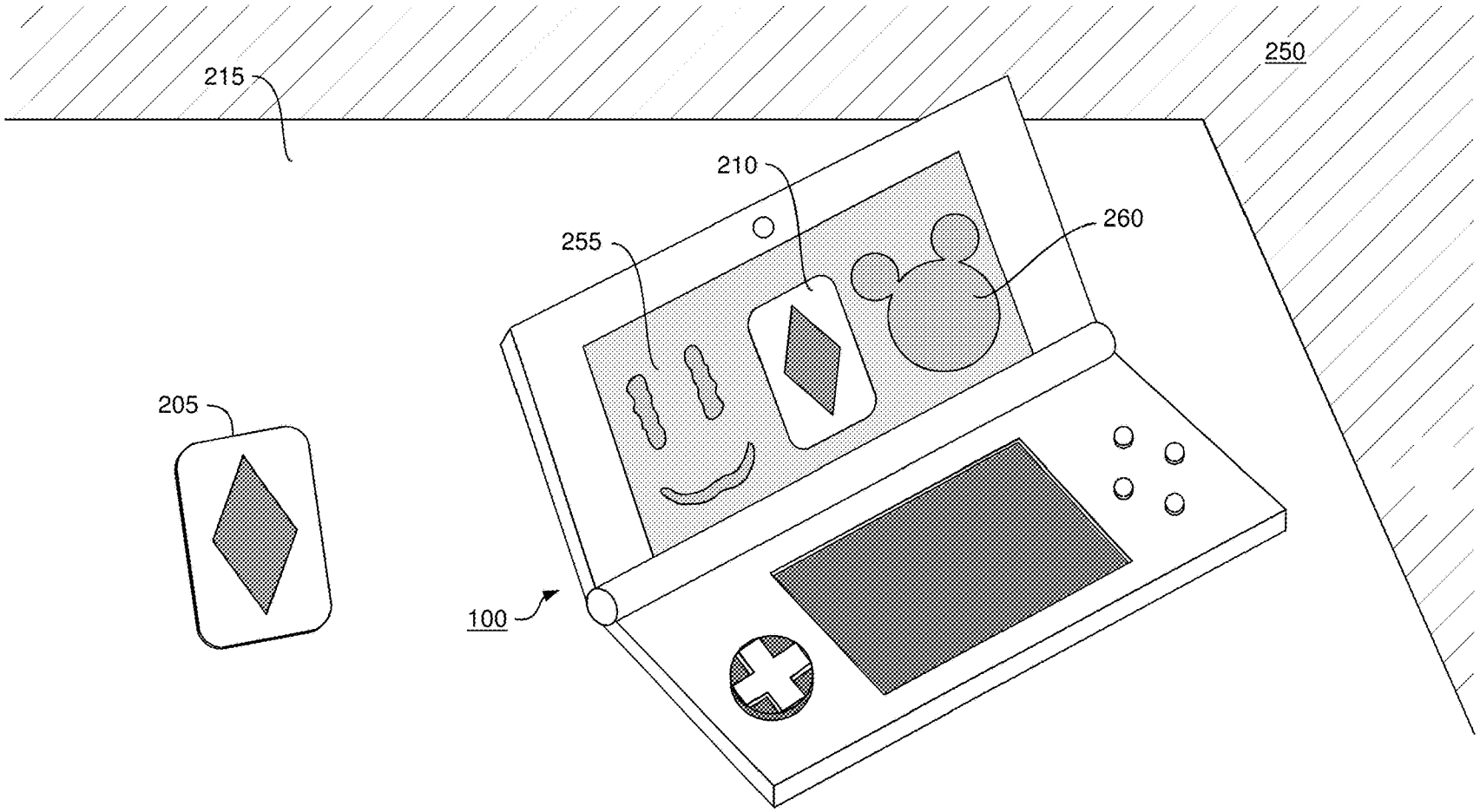

An example of this is shown in FIG. 2D, which depicts a scene 250 which includes a table 215, a physical card 205 resting atop the table 215, and an augmented reality device 100. The display of the augmented reality device 100 shows a virtual representation 210 of the physical card 205, a first freeform drawing 255 and a second freeform drawing 260. Here, the surface painting component 110 has received a request from the user to paint the freeform drawings 255 and 260 into the augmented reality scene and has inserted the drawings 255 and 260 onto the representation of the table 215 shown on the augmented reality device 100. As discussed above, the surface painting component 110 may insert the drawings 255 and 260 onto the surface of the table, such that the visual characteristics (e.g., size, shape, location, orientation, etc.) of the drawings 255 and 260 remain fixed within the three-dimensional augmented reality space. In other words, the drawings 255 and 260 will retain their position and dimensions relative to the virtual representation 210 of the physical card 205, regardless of the perspective from which the device 100 is viewing the physical card.

As such, the surface painting component 110 may display the drawings 255 and 260 with a different size and shape relative to the user's original free-form drawing, depending on the perspective from which the augmented reality device 100 is viewing the objects. For example, in the depicted scene 250, if the user were to view the physical card 205 from the opposite side of the table 215 using the augmented reality device 100, the drawings 255 and 260 would appear to be upside down. Moreover, because the surface painting component 110 projects the user's drawing onto surfaces within the augmented reality space, the user's drawing may be occluded by other objects within the augmented reality space depending on the perspective from which the drawings are viewed. That is, when the surface onto which the drawings are projected is occluded by another object, the drawings themselves may be occluded as well. Advantageously, by doing so, embodiments realistically portray the inserted drawings as part of the environment viewed on the augmented reality device 100, which creates a more immersive augmented reality experience for users of the device 100.

The surface painting component 110 may also be configured to consider other characteristics of surfaces within the augmented reality environment. Such characteristics could include, without limitation, at least one of a position of a light source within an environment in which the augmented reality device is located, an angle of the light source, an indication of whether the light source is omnidirectional, a color of the light source, an intensity of the light source and a reflectivity value of physical object within the environment. For instance, when projecting a drawing onto the surface of an object within the augmented reality environment, the surface painting component 110 could apply characteristics of the surface such as texture, reflectivity, etc. to the drawing.

Figure 3:
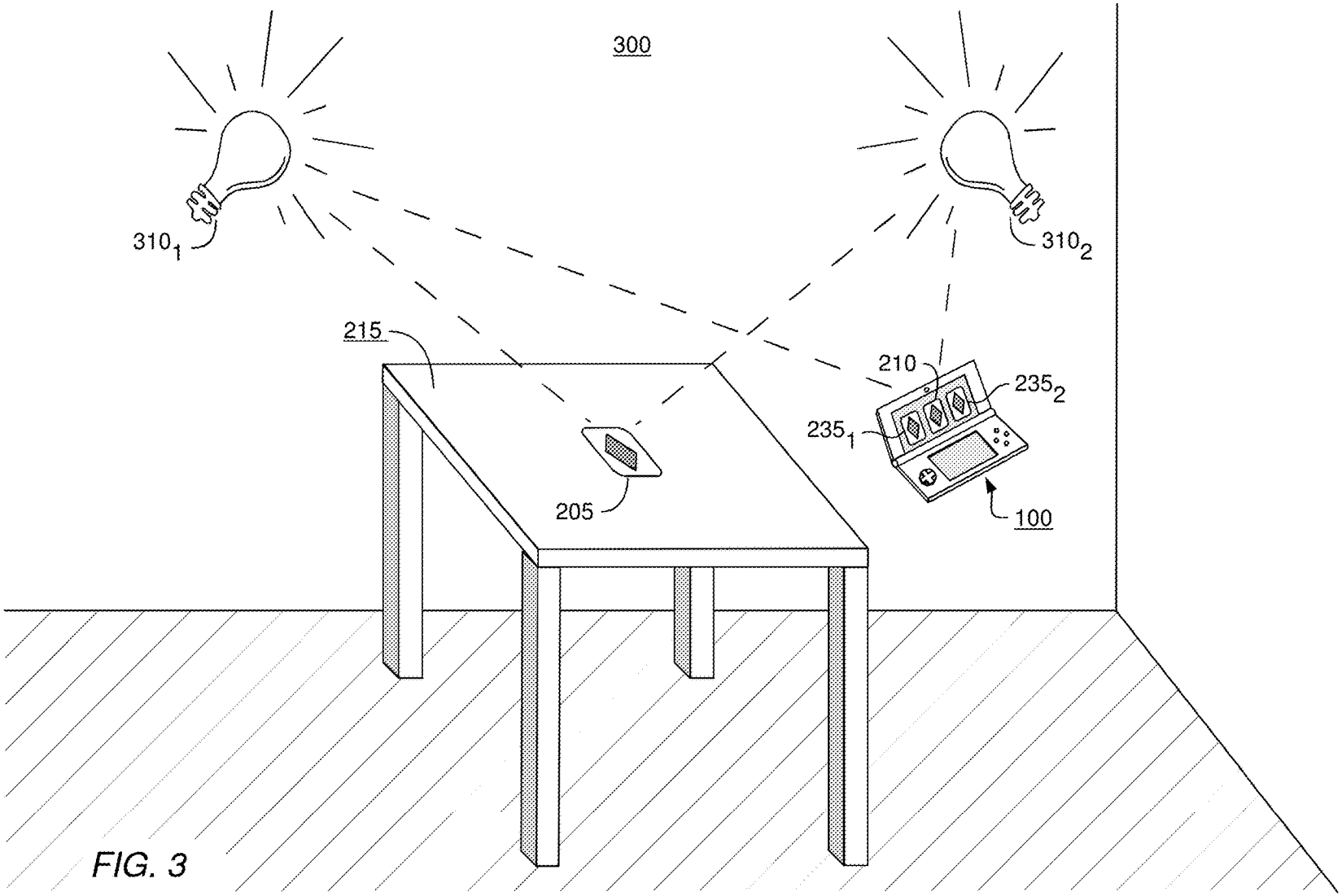
FIG. 3 is a diagram illustrating an environment containing an augmented reality device, according to one embodiment described herein.

An example of this will now be discussed with respect to FIG. 3, which is a diagram illustrating an environment containing an augmented reality device, according to one embodiment described herein. As shown, the scene 300 includes the table 215, the physical card 205 resting atop the table, the augmented reality device 100 and light sources $\mathbf{310}_{1\text{-}2}$. Additionally, the display of the augmented reality device 100 includes a virtual representation 210 of the physical card 205, as well as the two virtual cards $\mathbf{235}_{1\text{-}2}$ that the surface painting component 110 has painted into the augmented reality scene based on user input.

Here, the surface painting component 110 could be configured to analyze the physical environment in which the augmented reality device 100 is located. Additionally, the surface painting component 110 could identify visual characteristics of the painted virtual objects $\mathbf{235}_{1\text{-}2}$. Such visual characteristics could include, without limitation, a measure of reflectivity, a measure of transparency, a surface texture, and so on. In one embodiment, the surface painting component 110 is configured with predefined visual characteristic data corresponding to the predefined virtual objects users can paint into an augmented reality scene. In another embodiment, the user could specify the visual characteristics when the user paints the virtual objects $\mathbf{235}_{1\text{-}2}$ into the augmented reality scene. For example, the user could manually select a size, a texture, and a measure of reflectivity for each of the virtual objects $\mathbf{235}_{1\text{-}2}$. Of course, such an example is without limitation and is provided for illustrative purposes only, and more generally any visual characteristics applicable to virtual objects within an augmented reality space can be used in accordance with embodiments described herein.

The surface painting component 110 could identify light sources within the physical environment. For instance, in the depicted scene 300, the surface painting component 110 could identify the light source $\mathbf{310}_1$ and the light source $\mathbf{310}_2$. In addition to identifying the presence of light sources within the environment, the surface painting component 110 could further determine illumination characteristics of each light source, including, without limitation, a position of the light source, an angle of the light source, an indication of whether the light source is omnidirectional, a color of the light source, and an intensity of the light source. For instance, the augmented reality device 100 could analyze images captured using the camera(s) 120 in order to identify the presence and characteristics of the light sources $\mathbf{310}_{1\text{-}2}$. The surface painting component 110 could further use the accelerometer 140 to monitor the augmented reality device's 100 position within the physical environment and could use this information, along with images from the cameras 120, to identify the three-dimensional position of the light sources $\mathbf{310}_{1\text{-}2}$ within the physical environment.

The surface painting component 110 could then adjust the appearance of the virtual objects $\mathbf{235}_{1\text{-}2}$, based on the visual characteristics of the objects $\mathbf{235}_{1\text{-}2}$ and further based on the illumination characteristics of the light sources $\mathbf{310}_{1\text{-}2}$. For example, if the virtual objects $\mathbf{235}_{1\text{-}2}$ have a high measure of reflectivity (i.e., as indicated by their visual characteristics), the surface painting component 110 could adjust the appearance of the virtual objects $\mathbf{235}_{1\text{-}2}$ to show a reflection of one or both of the light sources $310_{1-2}$. As an additional example, the surface painting component 110 could use texture information of the virtual objects $235_{1-2}$ in addition to the illumination characteristics of the light sources $310_{1-2}$ in order to realistically render the virtual objects $235_{1-2}$ (e.g., by rendering shadows created by the texture of a virtual object). Advantageously, doing so creates a more realistic augmented reality scene, which may in turn improve the user's augmented reality experience.

Figure 4:
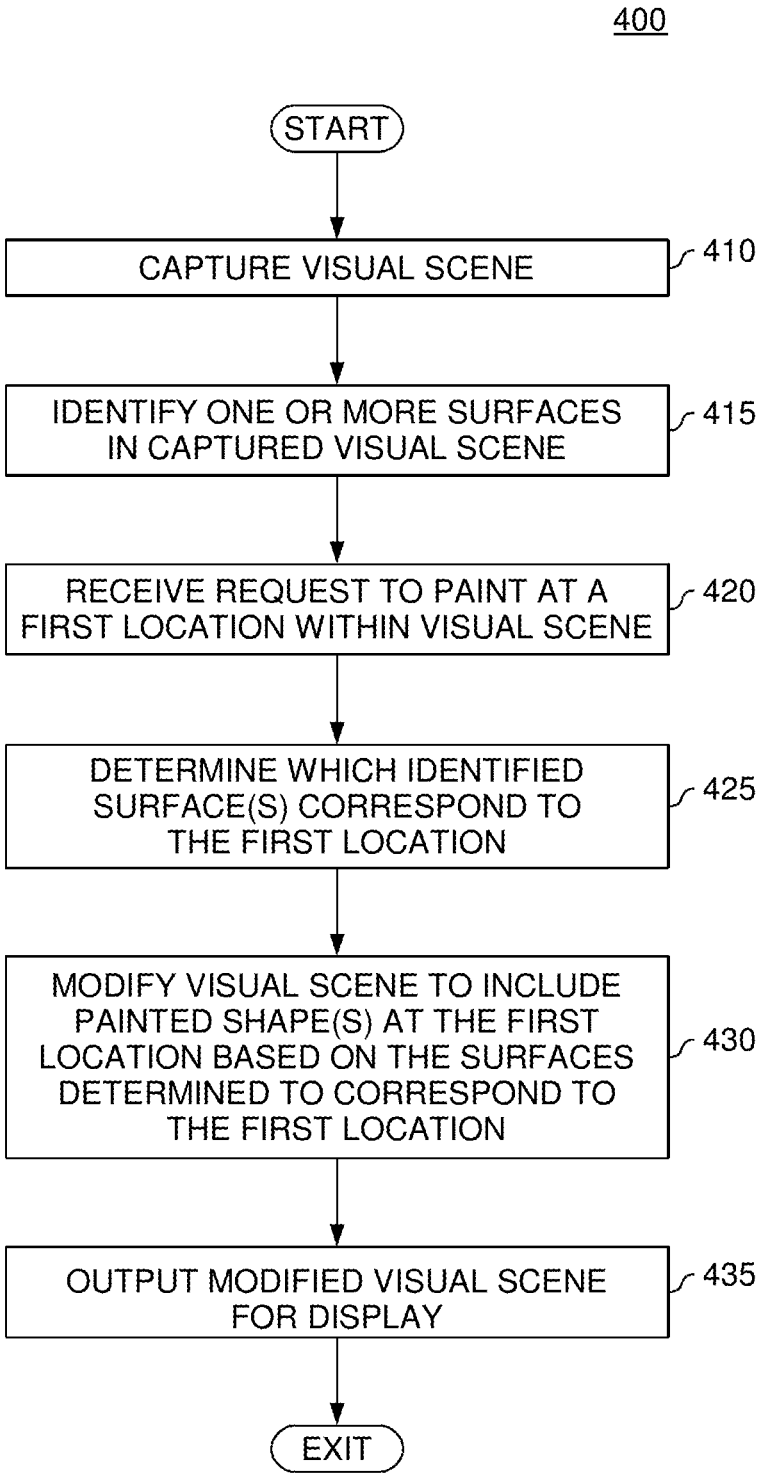
FIG. 4 is a flow diagram illustrating a method for painting surfaces within a scene displayed on an augmented reality device, according to one embodiment described herein.

FIG. 4 is a flow diagram illustrating a method for painting surfaces within a scene displayed on an augmented reality device, according to one embodiment described herein. As shown, the method 400 begins at step 410, where an augmented reality device captures a visual scene. As discussed above, the visual scene may include a plurality of frames representing a physical, real-world environment and captured using one or more cameras of the augmented reality device. The surface painting component 110 then estimates one or more surfaces of objects within the captured visual scene (step 415). For instance, the surface painting component 110 could be preconfigured with geometric data (e.g., dimensions information, shape information, etc.) for particular physical objects, and could use this geometric data to determine the surfaces of instances of these particular objects within the captured visual scene. In one embodiment, the surface painting component 110 is configured to identify the edges of objects within the captured visual scene, and to estimate the three-dimensional surfaces of these objects based on the determined edges.

In the depicted embodiment, the surface painting component 110 then receives a request to paint at a first location within the visual scene (step 420). Such a request could be formulated, for instance, based on user interaction with an interface of the augmented reality device. As an example, the surface painting component 110 could select a paintbrush icon displayed on the screen of the augmented reality device, and could then draw a freeform shape the user wishes to paint at first location within the scene displayed on the augmented reality device (e.g., using the user's finger to manipulate a touch screen of the augmented reality device). In a particular embodiment, the user may select a predefined virtual object to paint within the visual scene. For instance, the user could select a particular predefined object and could select a location within the visual scene in which to paint the selected predefined object.

In one embodiment, the user may draw the freeform shape using a physical paint brush or other stylus tool. For instance, the augmented reality device could be implemented as a pair of glasses worn by the user and configured to augment the area of the physical environment the user is looking at. As an example, the user could use a physical paint brush in order to paint onto the surface of an object in the physical environment. In such an embodiment, the surface painting component 110 could determine that the user is requesting to paint an object within the physical environment when the user touches the paint brush to the surface of the object. The surface painting component 110 could track the paint brush's motion (e.g., by analyzing frames captured using a camera of the augmented reality device) and could determine the freeform shape that the user wishes to paint based on the user's movement of the paint brush.

Upon receiving the request to paint within the visual scene at a specified location, the surface painting component 110 determines one or more object surfaces associated with the location specified by the request (step 425). That is, although the augmented reality device is displaying a two-dimensional image, the displayed two-dimensional image represents a view of a three-dimensional augmented reality space. As such, the surface painting component 110 determines which surface(s) of the three-dimensional objects in the three-dimensional augmented reality space correspond to the specified location of the two-dimensional displayed image displayed on the augmented reality device.

The surface painting component 110 then paints the determined surfaces as specified in the request (step 430). In one embodiment, the surface painting component 110 could recolor the surface of an object within the augmented reality space based on the user request. For instance, an interface of the augmented reality device could select a color and could use a fill tool to select a surface within the augmented reality scene to paint the selected color. In one embodiment, the user could select a freeform drawing tool and could use this tool to manually color in the surface of an object. In such an embodiment, the surface painting component 110 could be configured to detect when the user's freeform drawing covers more than a threshold amount of an object's surface and, if so, could determine that the user intends to paint the entire surface of the object in the specified color. The surface painting component 110 could then paint the surface accordingly. As another example, the surface painting component 110 could project a drawing (e.g., a freeform drawing or a predefined drawing selected by the user) onto the surface of an object. The modified visual scene including the painted objects is then output for display (step 435), and the method 400 ends.

As discussed above, because the surface painting component 110 is configured to paint the surfaces of three-dimensional objects within the augmented reality space, rather than to paint at the specified fixed location within the displayed two-dimensional scene, the painted surfaces may persist even when the objects are viewed from different perspectives using the augmented reality device. Thus, for example, although the painted objects may appear as having a different shape from viewed from certain perspectives (e.g., a coffee cup viewed from the side versus the same coffee cup viewed from above), or a different size when viewed from some perspectives (e.g., the same coffee cup when viewed up close versus far away), the objects will remain painted in the specified fashion. Additionally, the painted surface may be partially or completely occluded by other objects when viewed from other perspectives, but may still remain painted in the specified fashion when once again viewed from a perspective where all or part of the surface can be seen. Advantageously, doing so provides a more realistic augmented reality experience for users of the augmented reality device, as painted objects will appear as painted regardless of the angle from which the user views the objects using the augmented reality device.

Figure 5:
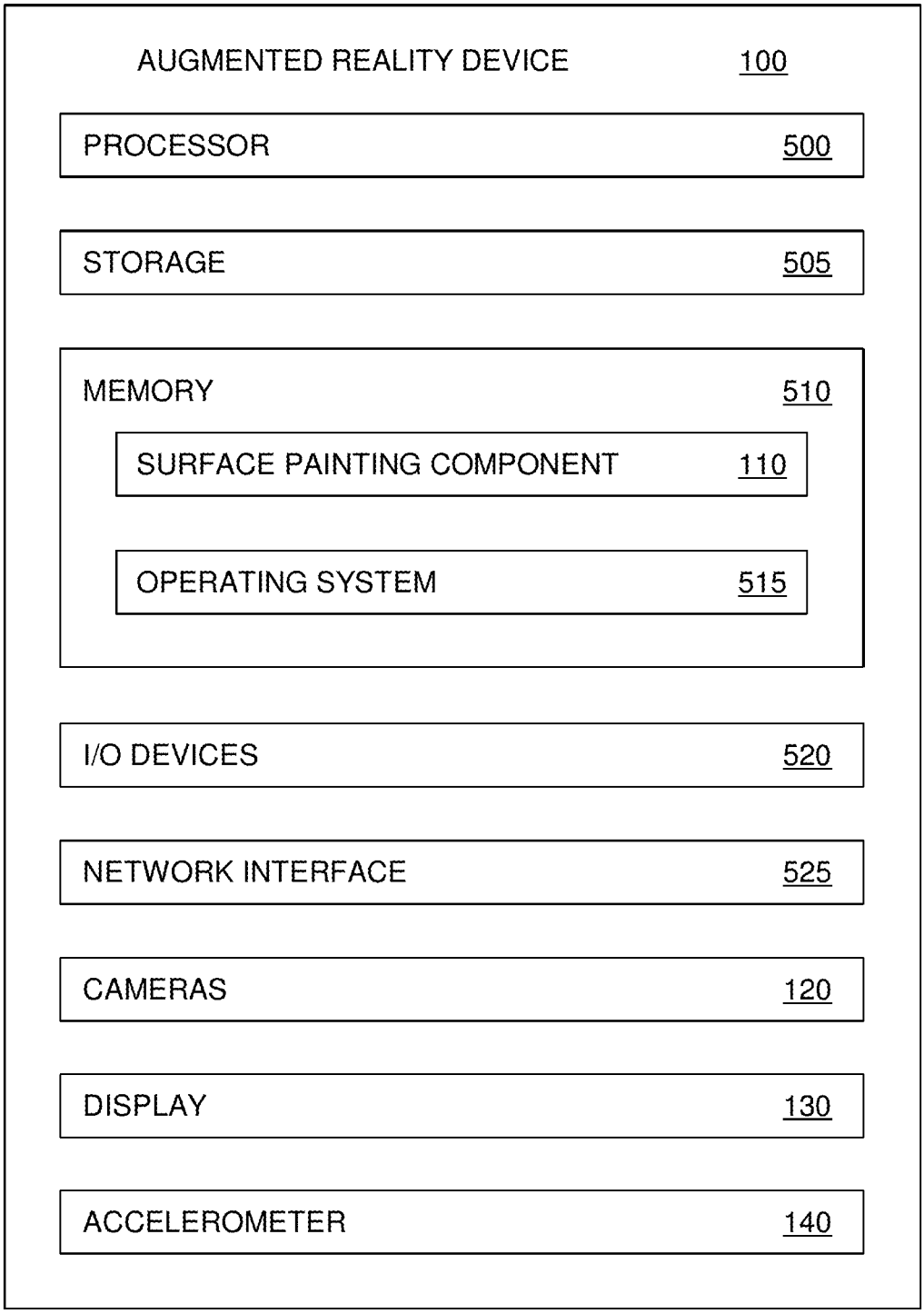
FIG. 5 is a block diagram illustrating an augmented reality device configured with a surface painting component, according to one embodiment described herein.

FIG. 5 is a block diagram illustrating an augmented reality device configured with a surface painting component, according to one embodiment described herein. In this example, the augmented reality device 100 includes, without limitation, a processor 500, storage 505, memory 510, I/O devices 520, a network interface 525, camera devices 120, a display devices 130 and an accelerometer device 140. Generally, the processor 500 retrieves and executes programming instructions stored in the memory 510. Processor 500 is included to be representative of a single CPU, multiple CPUs, a single CPU having multiple processing cores, GPUs having multiple execution paths, and the like. The memory 510 is generally included to be representative of a random access memory. The network interface 525 enables the augmented reality device 100 to connect to a data communications network (e.g., wired Ethernet connection or an 802.11 wireless network). Further, while the depicted embodiment illustrates the components of a particular augmented reality device 100, one of ordinary skill in the art will recognize that augmented reality devices may use a variety of different hardware architectures. Moreover, it is explicitly contemplated that embodiments of the invention may be implemented using any device or computer system capable of performing the functions described herein.

The memory 510 represents any memory sufficiently large to hold the necessary programs and data structures. Memory 510 could be one or a combination of memory devices, including Random Access Memory, nonvolatile or backup memory (e.g., programmable or Flash memories, read-only memories, etc.). In addition, memory 510 and storage 505 may be considered to include memory physically located elsewhere; for example, on another computer communicatively coupled to the augmented reality device 100. Illustratively, the memory 510 includes a display correction component 110 and an operating system 515. The operating system 515 generally controls the execution of application programs on the augmented reality device 100. Examples of operating system 515 include UNIX, a version of the Microsoft Windows® operating system, and distributions of the Linux® operating system. (Note: Linux is a trademark of Linus Torvalds in the United States and other countries.) Additional examples of operating system 515 include custom operating systems for gaming consoles, including the custom operating systems for systems such as the Nintendo DS® and Sony PSP®.

The I/O devices 520 represent a wide variety of input and output devices, including displays, keyboards, touch screens, and so on. For instance, the I/O devices 520 may include a display device used to provide a user interface. As an example, the display may provide a touch sensitive surface allowing the user to select different applications and options within an application (e.g., to select an instance of digital media content to view). Additionally, the I/O devices 520 may include a set of buttons, switches or other physical device mechanisms for controlling the augmented reality device 100. For example, the I/O devices 520 could include a set of directional buttons used to control aspects of a video game played using the augmented reality device 100.

The surface painting component 110 may generally paint the surfaces of objects within the augmented reality space with colors and/or shapes based on user input, where the surfaces are painted such that the painted colors and/or shapes remain in a fixed position on the objects' surfaces regardless of the perspective from which the physical scene is viewed. For instance, the surface painting component 110 could identify objects within a visual scene captured using one or more cameras 120 of the augmented reality device 100 and may further determine a three-dimensional area occupied by the identified objects within the augmented reality space. That is, the surface painting component 110 could determine the three-dimensional surfaces of each object. The surface painting component 110 could receive a request to paint a specified location within the captured visual scene (e.g., based on user input), and could identify one or more objects corresponding to the specified location. The surface painting component 110 could then paint one or more surfaces of the identified objects, such that the painting will remain in a fixed position on the objects' surface, even when the corresponding physical object is viewed from a different perspective. Advantageously, by painting objects within the augmented reality world in such a fashion, the surface painting component 110 creates a more realistic painting experience for users of the augmented reality device 100, as the objects will remain painted regardless of the perspective from which the user views the objects using the augmented reality device 100. This, in turn, may improve the user's experience when using the augmented reality device 100.

In the preceding, reference is made to embodiments of the invention. However, the invention is not limited to specific described embodiments. Instead, any combination of the following features and elements, whether related to different embodiments or not, is contemplated to implement and practice the invention. Furthermore, although embodiments of the invention may achieve advantages over other possible solutions and/or over the prior art, whether or not a particular advantage is achieved by a given embodiment is not limiting of the invention. Thus, the preceding aspects, features, embodiments and advantages are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

Aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described above with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

Embodiments of the invention may be provided to end users through a cloud computing infrastructure. Cloud computing generally refers to the provision of scalable computing resources as a service over a network. More formally, cloud computing may be defined as a computing capability that provides an abstraction between the computing resource and its underlying technical architecture (e.g., servers, storage, networks), enabling convenient, on-demand network access to a shared pool of configurable computing resources that can be rapidly provisioned and released with minimal management effort or service provider interaction. Thus, cloud computing allows a user to access virtual computing resources (e.g., storage, data, applications, and even complete virtualized computing systems) in "the cloud," without regard for the underlying physical systems (or locations of those systems) used to provide the computing resources.

Typically, cloud computing resources are provided to a user on a pay-per-use basis, where users are charged only for the computing resources actually used (e.g. an amount of storage space consumed by a user or a number of virtualized systems instantiated by the user). A user can access any of the resources that reside in the cloud at any time, and from anywhere across the Internet. In context of the present invention, a user may access environmental illumination data available in the cloud. For example, a surface painting component 110 could execute on an augmented reality device 100 operated by a user and collect environment illumination data pertaining to the user's current environment. In such a case, the surface painting component 110 could transmit the collected data to a computing system in the cloud for storage. When the user again returns to same environment, the surface painting component 110 could query the computer system in the cloud to retrieve the environmental illumination data and could then use the retrieved data to realistically model lighting effects on painted objects within an augmented reality scene displayed on the augmented reality device 100. Doing so allows a user to access this information from any device or computer system attached to a network connected to the cloud (e.g., the Internet).

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. Each block of the block diagrams and/or flowchart illustration, and combinations of blocks in the block diagrams and/or flowchart illustration, can be implemented by special-purpose hardware-based systems that perform the specified functions or acts, or combinations of special purpose hardware and computer instructions.

While the foregoing is directed to embodiments of the present invention, other and further embodiments of the invention may be devised without departing from the basic scope thereof, and the scope thereof is determined by the claims that follow.

What is claimed is:

1. A computer-implemented method to maintain conformity of a virtual painting onto a physical object captured and portrayed via an augmented reality device, even as the augmented reality device physically moves relative to the physical object in a physical environment over time, the computer-implemented method comprising:

presenting, via a display of the augmented reality device, the physical object within a visual scene captured in the physical environment using one or more camera devices of the augmented reality device, the physical object having an area of a first color;

receiving a request to at least partially fill the area using virtual paint of a second color different from the first color;

responsive to the request, identifying the physical object depicted by the visual scene, based on at least one of: (i) one or more edges determined for the physical object from analyzing the visual scene; and (ii) predefined geometrical data specifying geometrical characteristics of a specified type of the physical object;

determining one or more illumination characteristics of the physical environment;

generating, based on an initial image of the identified physical object in the visual scene and based further on the one or more illumination characteristics of the physical environment, an initial virtual painting projected onto the area of the physical object in the initial image and as viewed from a first physical position of the augmented reality device relative to the physical object in the physical environment; and responsive to the augmented reality device being moved from the first physical position to a second physical position relative to the physical object in the physical environment, the second physical position being distinct from the first physical position, generating, based on an updated image of the identified physical object in the visual scene and based further on the one or more illumination characteristics of the physical environment, an updated virtual painting projected onto the area of the physical object in the updated image and as viewed from the second physical position of the augmented reality device, wherein the updated virtual painting is visually distinct from the initial virtual painting in terms of at least one visual aspect selected from size, shape, orientation, pattern, and color;

wherein the updated virtual painting is generated in order to maintain conformity of the virtual painting onto the physical object even as the augmented reality device physically moves relative to the physical object in the physical environment over time, wherein the initial virtual painting and the updated virtual painting are output.

2. The computer-implemented method of claim 1, wherein identifying the physical object within the visual scene comprises:

analyzing the visual scene to determine the one or more edges of the physical object within the visual scene, wherein the physical object is detected based on the determined one or more edges.

3. The computer-implemented method of claim 1, wherein identifying the physical object within the visual scene comprises:

retrieving the predefined geometrical data, which specifies geometrical characteristics of the specified type of the physical object; and analyzing the visual scene using the predefined geometrical data in order to determine that the physical object is an instance of one of the specified type of physical object within the visual scene.

4. The computer-implemented method of claim 1, wherein the area is of a specific shape.

5. The computer-implemented method of claim 1, wherein the one or more illumination characteristics include at least one of a position of a light source within the physical environment, an angle of the light source, an indication of whether the light source is omnidirectional, a color of the light source, an intensity of the light source, and a reflectivity value of the physical object.

6. The computer-implemented method of claim 1, wherein the request specifies to remove content at a first location within the visual scene, wherein adjusting the visual scene by painting at least a portion of the identified first object comprises:

removing the portion of the identified physical object from the visual scene as portrayed by the augmented reality device; and replacing the removed portion with replacement content that is displayed by the augmented reality device, wherein the replacement content is determined based at least in part on content within the visual scene surrounding the removed portion of the identified physical object in the physical environment.

7. The computer-implemented method of claim 1, further comprising:

upon detecting that at least a predefined threshold of the physical object has been painted, rendering a series of frames depicting the physical object as an animated virtual object within the visual scene.

8. The computer-implemented method of claim 1, wherein the area is at least partially filled using the virtual paint of the second color as viewed from the augmented reality device, wherein the area is of a specific shape on one or more surfaces of the physical object, wherein the computer-implemented method further comprises:

generating a plurality of virtual objects corresponding to the physical object and portrayed at distinct locations separate from a physical location of the physical object in the physical environment;

wherein each of the plurality of virtual objects is visually distinct from the physical object in terms of at least one visual aspect selected from size, shape, orientation, pattern, and color, wherein each of the plurality of virtual objects is visually distinct from one another in terms of at least one visual aspect selected from size, shape, orientation, pattern, and color;

wherein each of the plurality of virtual objects is updated in order to maintain conformity of the respective virtual object to the physical environment as portrayed by the augmented reality device, in order to simulate actual presence of the respective virtual object in the physical environment;

wherein the presence of the respective virtual object is simulated at a respective physical location, in the physical environment, that is not occupied by any physical object;

wherein the conformity of the respective virtual object to the physical environment is maintained even as the augmented reality device physically moves relative to the respective physical location over time, wherein the respective updated virtual object is output via the augmented reality device.

9. The computer-implemented method of claim 8, wherein the area is at least substantially filled using the virtual paint of the second color as viewed from the augmented reality device, wherein the computer-implemented method further comprises:

rendering a series of frames depicting the physical object, wherein the area remains painted in the rendered series of frames when the physical object is viewed from different perspectives as a physical position of the augmented reality device changes relative to the physical object, wherein rendering the series of frames comprises:

inserting the initial virtual painting into a first frame of the series of frames, when the physical object is viewed from the first physical position of the augmented reality device relative to the physical object; and inserting the updated virtual painting into a second frame of the series of frames, when the physical object is viewed from the second physical position of the augmented reality device relative to the physical object.

10. The computer-implemented method of claim 9, wherein the area is completely filled using the virtual paint of the second color as viewed from the augmented reality device, wherein the updated virtual painting is visually distinct from the initial virtual painting in terms of at least two visual aspects selected from size, shape, orientation, pattern, and color, wherein the specified type comprises a first of a plurality of specified types of physical objects, wherein the augmented reality device is configured to identify the physical object within the visual scene by:

in a first instance, analyzing the visual scene based on the one or more edges determined for the physical object, wherein the physical object is detected based on the determined one or more edges; and in a second instance: (i) retrieving predefined geometrical data specifying geometrical characteristics of the plurality of specified types of physical objects, including the predefined geometrical data specifying geometrical characteristics of the specified type of the physical object; and (ii) analyzing the visual scene based on the retrieved, predefined geometrical data in order to determine that the physical object corresponds to the first specified type.

11. The computer-implemented method of claim 10, wherein the updated virtual painting is visually distinct from the initial virtual painting in terms of at least three visual aspects selected from size, shape, orientation, pattern, and color.

12. The computer-implemented method of claim 11, wherein the updated virtual painting is visually distinct from the initial virtual painting in terms of at least four visual aspects selected from size, shape, orientation, pattern, and color, wherein the received request further specifies: (i) a desired texture for the specific shape and (ii) a desired pattern for the specific shape, wherein each of the initial virtual painting and the updated virtual painting is generated based further on the desired texture and the desired pattern, wherein the one or more illumination characteristics are determined based on: (i) the visual scene captured using the one or more camera devices of the augmented reality device and (ii) accelerometer data captured by an accelerometer component of the augmented reality device;

wherein the one or more illumination characteristics include: (i) a position of a light source within the physical environment; (ii) an angle of the light source; (iii) an indication of whether the light source is omnidirectional; (iv) a color of the light source; (v) an intensity of the light source; and (vi) a reflectivity value of the physical object.

13. The computer-implemented method of claim 12, wherein the updated virtual painting is visually distinct from the initial virtual painting in terms of each visual aspect selected from size, shape, orientation, pattern, and color, wherein the request specifies to remove content at the first location within the visual scene, wherein the physical object corresponds to the first of specified type of physical object, wherein adjusting the visual scene by painting at least a portion of the identified first object further comprises:

removing the at least a portion of the identified physical object from the visual scene as portrayed by the augmented reality device;

replacing the removed portion with replacement content that is displayed by the augmented reality device, wherein the replacement content is determined based at least in part on content within the visual scene surrounding the removed portion of the identified physical object in the physical environment;

wherein the replacement content is updated in order to maintain absence of the removed portion from the physical environment even as the augmented reality device physically moves relative to the removed portion in the physical environment over time, wherein the updated replacement content is output via the augmented reality device; and only upon detecting that at least a predefined threshold of the physical object has been painted, rendering a series of frames depicting the physical object as an animated virtual object within the visual scene as portrayed by the augmented reality device.

14. An augmented reality device to maintain conformity of a virtual painting onto a physical object captured and portrayed via the augmented reality device, even as the augmented reality device physically moves relative to the physical object in a physical environment over time, the augmented reality device comprising:

a processor; and a memory containing a program that, when executed by the processor, performs an operation comprising:

presenting, via a display of the augmented reality device, the physical object within a visual scene captured in the physical environment using one or more camera devices of the augmented reality device, the physical object having an area of a first color;

receiving a request to at least partially fill the area using virtual paint of a second color different from the first color;

responsive to the request, identifying the physical object depicted by the visual scene, based on at least one of: (i) one or more edges determined for the physical object from analyzing the visual scene; and (ii) predefined geometrical data specifying geometrical characteristics of a specified type of the physical object;

determining one or more illumination characteristics of the physical environment;

generating, based on an initial image of the identified physical object in the visual scene and based further on the one or more illumination characteristics of the physical environment, an initial virtual painting projected onto the area of the first physical object in the initial image and as viewed from a first physical position of the augmented reality device relative to the physical object in the physical environment;

responsive to the augmented reality device being moved from the first physical position to a second physical position relative to the physical object in the physical environment, the second physical position being distinct from the first physical position, generating, based on an updated image of the identified physical object in the visual scene and based further on the one or more illumination characteristics of the physical environment, an updated virtual painting projected onto the area of the physical object in the updated image and as viewed from the second physical position of the augmented reality device, wherein the updated virtual painting is visually distinct from the initial virtual painting in terms of at least one visual aspect selected from size, shape, orientation, pattern, and color;

wherein the updated virtual painting is generated in order to maintain conformity of the virtual painting onto the physical object even as the augmented reality device physically moves relative to the physical object in the physical environment over time, wherein the initial virtual painting and the updated virtual painting are output.

15. The augmented reality device of claim 14, wherein identifying the physical object within the visual scene comprises:

analyzing the visual scene to determine the one or more edges of the physical object within the visual scene, wherein the physical object is detected based on the determined one or more edges.

16. The augmented reality device of claim 14, wherein identifying the physical object within the visual scene comprises:

retrieving the predefined geometrical data, which specifies geometrical characteristics of the specified type of the physical object; and analyzing the visual scene using the predefined geometrical data in order to determine that the physical object is an instance of one of the specified type of physical object within the visual scene.

17. The augmented reality device of claim 14, wherein the area is of a specific shape.

18. The augmented reality device of claim 14, wherein the one or more illumination characteristics include at least one of a position of a light source within the physical environment, an angle of the light source, an indication of whether the light source is omnidirectional, a color of the light source, an intensity of the light source, and a reflectivity value of the physical object.

19. The augmented reality device of claim 14, wherein the request specifies to remove content at a first location within the visual scene, wherein adjusting the visual scene by painting at least a portion of the identified first object comprises:

removing the portion of the identified physical object from the visual scene as portrayed by the augmented reality device; and replacing the removed portion with replacement content that is displayed by the augmented reality device, wherein the replacement content is determined based at least in part on content within the visual scene surrounding the removed portion of the identified physical object in the physical environment.

20. The augmented reality device of claim 14, the operation further comprising:

upon detecting that at least a predefined threshold of the physical object has been painted, rendering a series of frames depicting the physical object as an animated virtual object within the visual scene.

21. A non-transitory computer-readable medium containing a program that, when executed, performs an to maintain conformity of a virtual painting onto a physical object captured and portrayed via an augmented reality device, even as the augmented reality device physically moves relative to the physical object in a physical environment over time, the operation comprising:

presenting, via a display of the augmented reality device, the physical object within a visual scene captured in the physical environment using one or more camera devices of the augmented reality device, the physical object having an area of a first color;

receiving a request to at least partially fill the area using virtual paint of a second color different from the first color;

responsive to the request, identifying the physical object depicted by the visual scene, based on at least one of: (i) one or more edges determined for the physical object from analyzing the visual scene; and (ii) predefined geometrical data specifying geometrical characteristics of a predefined type of the physical object;

determining one or more illumination characteristics of the physical environment;

generating, based on an initial image of the identified physical object in the visual scene and based further on the one or more illumination characteristics of the physical environment, an initial virtual painting projected onto the area of the physical object in the initial image and as viewed from a first physical position of the augmented reality device;

responsive to the augmented reality device being moved from the first physical position to a second physical position relative to the physical object in the physical environment, the second physical position being distinct from the first physical position, generating, based on an updated image of the identified physical object in the visual scene and based further on the one or more illumination characteristics of the physical environment, an updated virtual painting projected onto the area the physical object in the updated image and as viewed from the second physical position of the augmented reality device, wherein the updated virtual painting is visually distinct from the initial virtual painting in terms of at least one visual aspect selected from size, shape, orientation, pattern, and color;

wherein the updated virtual painting is generated in order to maintain conformity of the virtual painting onto the physical object even as the augmented reality device physically moves relative to the physical object in the physical environment over time, wherein the initial virtual painting and the updated virtual painting are output.

22. The non-transitory computer-readable medium of claim 21, wherein identifying the physical object within the visual scene comprises:

analyzing the visual scene to determine the one or more edges of the physical object within the visual scene, wherein the physical object is detected based on the determined one or more edges.

23. The non-transitory computer-readable medium of claim 21, wherein identifying the physical object within the visual scene comprises:

retrieving the predefined geometrical data, which specifies geometrical characteristics of the specified type of the physical object; and analyzing the visual scene using the predefined geometrical data in order to determine that the physical object is an instance of one of the specified type of physical object within the visual scene.

24. The non-transitory computer-readable medium of claim 21, wherein the area is of a specific shape.

25. The non-transitory computer-readable medium of claim 21, wherein the one or more illumination characteristics include at least one of a position of a light source within the physical environment, an angle of the light source, an indication of whether the light source is omnidirectional, a color of the light source, an intensity of the light source, and a reflectivity value of the physical object.

26. The non-transitory computer-readable medium of claim 21, wherein the request specifies to remove content at a first location within the visual scene, wherein adjusting the visual scene by painting at least a portion of the identified first object comprises:

removing the portion of the identified physical object from the visual scene as portrayed by the augmented reality device; and replacing the removed portion with replacement content that is displayed by the augmented reality device, wherein the replacement content is determined based at least in part on content within the visual scene surrounding the removed portion of the identified physical object in the physical environment.

27. The non-transitory computer-readable medium of claim 21, the operation further comprising:

upon detecting that at least a predefined threshold of the physical object has been painted, rendering a series of frames depicting the physical object as an animated virtual object within the visual scene.

* * * * *